US007491185B2

(12) United States Patent
Couvillon, Jr.

(10) Patent No.: US 7,491,185 B2
(45) Date of Patent: Feb. 17, 2009

(54) EXTERNAL COUNTERPULSATION DEVICE USING ELECTROACTIVE POLYMER ACTUATORS

(75) Inventor: Lucien A. Couvillon, Jr., Concord, MA (US)

(73) Assignee: Boston Scientific Scimed, Inc., Maple Grove, MN (US)

( * ) Notice: Subject to any disclaimer, the term of this patent is extended or adjusted under 35 U.S.C. 154(b) by 476 days.

(21) Appl. No.: 10/645,814

(22) Filed: Aug. 21, 2003

(65) Prior Publication Data

US 2005/0043657 A1 Feb. 24, 2005

(51) Int. Cl.
*A61H 7/00* (2006.01)
*A61H 11/00* (2006.01)
*A61H 23/00* (2006.01)

(52) U.S. Cl. ..... 601/148; 601/149; 601/152; 601/DIG. 20

(58) Field of Classification Search ..... 601/148–152, 601/133, 134, 44, DIG. 20
See application file for complete search history.

(56) References Cited

U.S. PATENT DOCUMENTS

| | | | | |
|---|---|---|---|---|
| 3,455,298 | A | 7/1969 | Anstadt | |
| 4,014,318 | A | 3/1977 | Dockum et al. | 128/1 |
| 4,077,402 | A | 3/1978 | Benjamin, Jr. et al. | 128/24 |
| 4,192,293 | A | 3/1980 | Asrican | 128/1 |
| 4,302,854 | A | 12/1981 | Runge | 3/1.7 |
| 4,304,225 | A | 12/1981 | Freeman | 128/60 |
| 4,448,190 | A | 5/1984 | Freeman | 128/60 |
| 4,506,658 | A | 3/1985 | Casile | 128/1 |
| 4,522,698 | A | 6/1985 | Maget | 204/301 |
| 4,621,617 | A | 11/1986 | Sharma | 128/1 |
| 4,690,134 | A | 9/1987 | Snyders | 128/64 |
| 4,925,443 | A | 5/1990 | Heilman et al. | 600/16 |
| 4,957,477 | A | 9/1990 | Lundback | 600/16 |
| 5,098,369 | A | 3/1992 | Heilman et al. | 600/16 |
| 5,131,905 | A | 7/1992 | Grooters | 600/16 |
| 5,169,381 | A | 12/1992 | Snyders | 600/16 |
| 5,250,167 | A | 10/1993 | Adolf et al. | 204/299 |
| 5,383,840 | A | 1/1995 | Heilman et al. | 600/17 |
| 5,389,222 | A | 2/1995 | Shahinpoor | 204/299.2 |
| 5,554,103 | A | 9/1996 | Zheng et al. | 601/152 |
| 5,556,700 | A | 9/1996 | Kaneto et al. | 428/332 |
| 5,558,617 | A | 9/1996 | Heilman et al. | 600/16 |
| 5,769,800 | A | 6/1998 | Gelfand et al. | 601/151 |
| 6,010,471 | A | 1/2000 | Ben-noon | 601/152 |
| 6,084,321 | A | 7/2000 | Hunter et al. | 310/20 |
| 6,109,852 | A | 8/2000 | Shahinpoor et al. | 414/1 |
| 6,123,681 | A * | 9/2000 | Brown, III | 602/75 |
| 6,179,793 | B1 | 1/2001 | Rothman et al. | 601/44 |
| 6,198,204 | B1 | 3/2001 | Pottenger | 310/326 |

(Continued)

FOREIGN PATENT DOCUMENTS

EP 1 324 403 A1 7/2003

(Continued)

*Primary Examiner*—Danton DeMille
(74) *Attorney, Agent, or Firm*—Mayer & Williams PC; David B. Bonham, Esq.; Keum J. Park, Esq.

(57) ABSTRACT

The present invention provides an exterior counterpulsation (ECP) system that includes a garment for being worn on the exterior of a patient's body. The garment includes electroactive polymer (EAP) actuators connected thereto. In one embodiment, the EAP actuators are woven into the garment. In another embodiment, they are mounted to the garment surface.

32 Claims, 2 Drawing Sheets

U.S. PATENT DOCUMENTS

| | | | | |
|---|---|---|---|---|
| 6,249,076 | B1 * | 6/2001 | Madden et al. | 310/363 |
| 6,261,250 | B1 | 7/2001 | Phillips | 301/23 |
| 6,376,971 | B1 | 4/2002 | Pelrine et al. | 310/363 |
| 6,464,655 | B1 | 10/2002 | Shahinpoor | 601/153 |
| 6,494,852 | B1 * | 12/2002 | Barak et al. | 601/151 |
| 6,514,237 | B1 | 2/2003 | Maseda | 604/533 |
| 6,545,384 | B1 | 4/2003 | Pelrine et al. | 310/309 |
| 6,572,621 | B1 | 6/2003 | Zheng et al. | 606/64 |
| 6,589,267 | B1 | 7/2003 | Hui | 606/202 |
| 6,592,502 | B1 | 7/2003 | Phillips | 482/143 |
| 6,809,462 | B2 * | 10/2004 | Pelrine et al. | 310/319 |
| 2004/0230090 | A1 * | 11/2004 | Hegde et al. | 600/18 |
| 2005/0137507 | A1 * | 6/2005 | Shabty et al. | 601/150 |

FOREIGN PATENT DOCUMENTS

| | | |
|---|---|---|
| WO | WO 99/11215 | 3/1999 |

* cited by examiner

EXTERNAL COUNTERPULSATION DEVICE USING ELECTROACTIVE POLYMER ACTUATORS

BACKGROUND OF THE INVENTION

The present invention describes an external counterpulsation device. More specifically, the present invention applies electroactive polymer actuators to an external counterpulsation device.

Exterior counterpulsation (ECP) is a technique in which the exterior of a patient's body is compressed (usually the extremities such as the legs) in synchrony with the heartbeat of the patient in order to assist the pumping action of the heart. ECP is established, for example, in critical care and cardiology units for treatment of heart failure and for the rescue of heart attack patients.

There are several current manufacturers of ECP systems. The current systems resemble a pair of trousers or support hosiery, and function in a way similar to that of a gravity garment used by pilots of certain aircraft. Pneumatic tubes are connected to the garment to compress the patient's extremities (usually the legs) in synchrony with the heartbeat. This assists the pumping action of the heart by forcing blood from the extremities by compressing the veins and relying on the venous valves to favor one-way flow, so the heart need not do all the work of perfusion. The resultant reduction in cardiac work allows normalization of blood flow and metabolism, reduces the otherwise destructive downward metabolic spiral, and allows the heart to rest and recover.

However, present ECP systems suffer from a number of disadvantages. As described above, the actuators in conventional ECP systems are traditionally pneumatic. Such actuators are typically rather large and bulky leading to a clumsy fit around the patient. The size and bulk of the actuators can also render them quite cumbersome and uncomfortable in attempting to fit them on a patient. In addition, the large pneumatic actuators are typically quite noisy and difficult to control. Also, they are relatively slowly acting. Therefore, they are difficult to control in precise synchrony with the heartbeat. Further, the actuators are quite expensive, mechanically inefficient, and require a bulky, complex pneumatic drive console.

SUMMARY OF THE INVENTION

The present invention provides an exterior counterpulsation (ECP) system that includes a garment for being worn on the exterior of a patient's body. The garment includes electroactive polymer (EAP) actuators connected thereto. In one embodiment, the EAP actuators are woven into the garment. In another embodiment, they are mounted upon the garment surface.

In one embodiment, the system of the present invention includes a controller that drives actuation of the EAP actuators. In yet another embodiment, the system includes a heart monitor (such as an electrocardiogram (EKG) component). The controller receives an output from the EKG component and drives actuation of the EAP actuators in synchrony with the natural heart rhythm.

In still another embodiment, a feedback component is provided. The controller controls actuation of the EAP actuators to shift location and timing of the applied pressure in order to increase the flow response and metabolic benefit obtained.

DETAILED DESCRIPTION OF THE ILLUSTRATIVE EMBODIMENTS

Figure 1:
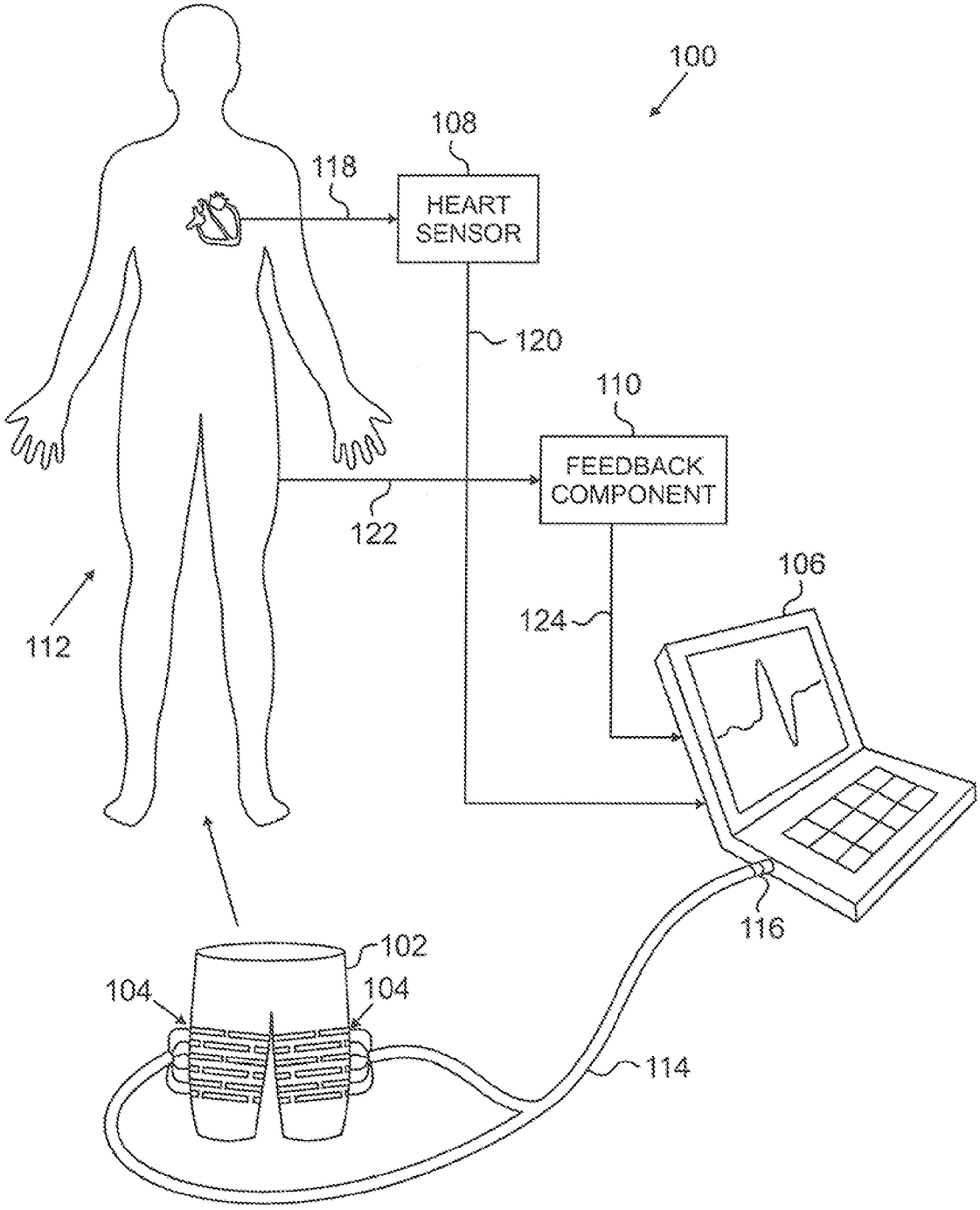
FIG. 1 is a diagrammatic illustration of an exterior counterpulsation system in accordance with one embodiment of the present invention.

Prior to discussing the present invention in greater detail, a brief description of one illustrative embodiment of the actuators used in accordance with the present invention will be undertaken. Electroactive polymer (EAP) actuators typically include an active member, a counter electrode and an electrolyte-containing region disposed between the active member and the counter electrode. In some embodiments, a substrate is also provided, and the active member, the counter electrode and the electrolyte-containing region are disposed over the substrate layer. Some examples of electroactive polymers that can be used as the electroactive polymer actuator of the present invention include polyaniline, polypyrrole, polysulfone, and polyacetylene.

Actuators formed of these types of electroactive polymers are typically small in size, exhibit large forces and strains, are low cost and are relatively easy to integrate into another device, such as a garment. These polymers are members of the family of plastics referred to as "conducting polymers" which are characterized by their ability to change shape in response to electrical stimulation. They typically structurally feature a conjugated backbone and have the ability to increase electrical conductivity under oxidation or reduction. These materials are typically not good conductors in their pure form. However, upon oxidation or reduction of the polymer, conductivity is increased. The oxidation or reduction leads to a charge imbalance that, in turn, results in a flow of ions into the material in order to balance charge. These ions or dopants, enter the polymer from an ionically conductive electrolyte medium that is coupled to the polymer surface. The electrolyte may be, for example, a gel, a solid, or a liquid. If ions are already present in the polymer when it is oxidized or reduced, they may exit the polymer.

It is well known that dimensional changes may be effectuated in certain conducting polymers by the mass transfer of ions into or out of the polymer. For example, in some conducting polymers, the expansion is due to ion insertion between changes, wherein as in others inter-charge repulsion is the dominant effect. Thus, the mass transfer of ions into and out of the material leads to the expansion or contraction of the polymer.

Currently, linear and volumetric dimensional changes on the order of 25 percent are possible. The stress arising from the change can be on the order of three MPa (1 megapascal, MPa, is about 145 psi) far exceeding that exhibited by smooth muscle cells, thereby allowing substantial forces to be exerted by actuators having very small cross-sections. These characteristics are favorable for construction of an external counterpulsation system in accordance with the present invention.

As one specific example, current intrinsic polypyrrole fibers shorten and elongate on the order of two percent with a direct current drive input of 2 to 10 volts at approximately 2-5 milliamperes. Other fibers, such as polysulfones, exceed these strains. The polyprrole fibers, as well as other electroactive polymers generate forces which can exceed the 0.35 MPa of mammalian muscle by two orders of magnitude.

Additional information regarding the construction of such actuators, their design considerations and the materials and components that may be deployed therein can be found, for example, in U.S. Pat. No. 6,249,076 assigned to Massachusetts Institute of Technology, U.S. Pat. No. 6,545,384 to Pelrine et al., U.S. Pat. No. 6,376,971, to Pelrine et al., and in Proceedings of SPIE Vol. 4329 (2001) entitled *SMART STRUCTURES AND MATERIALS* 2001: *ELECTROACTIVE POLYMER AND ACTUATOR DEVICES* (see in particular, Madden et al., Polypyrrole actuators, modeling and performance, at pages 72-83) and in U.S. patent application Ser. No. 10/262,829 entitled THROMBOLYSIS CATHETER assigned to the same assignee as the present invention.

FIG. 1 is a diagrammatic illustration of an exterior counterpulsation (ECP) system 100 in accordance with one embodiment of the present invention. ECP system 100 includes a garment 102 with electroactive polymers 104 connected thereto. System 100 also includes controller 106, heart sensor 108 and optional feedback component 110. Garment 102 is illustrated as a pair of trousers, or support hosiery. However, garment 102 can be formed as any desirable garment which fits over a desired portion of the body of a patient 112. In the Example illustrated in FIG. 1, it is desired to exert external counterpulsation force upon the lower extremities of patient 112. Therefore, garment 102 is fashioned as a pair of trousers. However, where it is desired to compress other or additional portions of the body of patient 112, garment 102 can take a different form, or additional garments such as sleeves or cuffs can be formed to cover different portions of patient 112.

In any case, garment 102 is illustratively formed of a flexible material. The material is illustratively relatively tight fitting around the desired body portion of patient 112. Therefore, some examples of material which may be used for garment 102 include relatively tight fitting, resilient, materials such as spandex or lycra. Of course, any other relatively tight fitting and flexible materials could be used as well. Suffice it to say that material used in garment 102 is illustratively a generally flexible material which can move under the influence of actuators 104 to exert pressure on the desired body portion of patient 112, and then relax to allow natural blood flow to occur. Thus, garment 102 can be formed of any suitable material, such as a flexible polymer, a flexible mesh or woven fabric.

As shown in FIG. 1, garment 102 illustratively has a plurality of electroactive polymer (EAP) actuators 104 connected thereto. In one embodiment, actuators 104 are, themselves, formed of fibers (such as polypyrrole fibers) which are directly woven into the material of garment 102. In still another embodiment, the fibers of electroactive polymer material are woven or otherwise formed into the actuators illustrated in FIG. 1, and the actuators are, themselves, woven into the material of garment 102. In still another embodiment, the garment and actuators are formed separately, and the actuators 104 are attached by stitching, adhesive, or another form of mechanical attachment to either the interior or exterior of garment 102. In still a further embodiment, garment 102 is a multilayer garment, and the electroactive polymer actuators 104 are disposed between the layers of garment 102.

EAP actuators 104 are connected to controller 106 by a cable or harness assembly 114. Assembly 114 illustratively plugs into a port 116 of controller 106 which provides a control signal to EAP actuators 104 to control actuation of those actuators. In one illustrative embodiment, assembly 114 is a multiplex cable for carrying an electrical control signal to control actuation of actuators 104. The control signal may be, for example, a signal ranging from 2-10 volts at 2-10 milliamperes, generated on an output port of controller 106. In any case, it can be seen that controller 106 provides an output to control actuation of actuators 104.

Controller 106, in one embodiment, can illustratively be implemented using any of a wide variety of computing devices. While controller 106 is generally illustrated in FIG. 1 as a laptop computer, it can be a desktop computer, a personal digital assistant (PDA), a palmtop or handheld computer, even a mobile phone or other computing device, or a dedicated special-purpose electronic control device. In addition, computing device 106 can be stand-alone, part of a network or simply a terminal which is connected to a server or another remote computing device. The network (if used) can include a local area network (LAN) a wide area network (WAN) with a wireless link, or any other suitable connection. In any case, controller 106 illustratively includes a communication interface, or power interface, for providing the signals over link 114 to control actuation of actuators 104.

It should also be noted that link 114 is illustrated as a cable that has a first connector connected to the communication or power electronics in controller 106 and a second connector which is connected to provide signals to actuators 104. However, the first connection to controller 106 can also be a different type of connection, such as a wireless connection which provides the desired signals to actuators 104 using electromagnetic energy, or any other desired type of link.

The controller 106 also illustratively receives an input from heart sensor 108. Heart sensor 108 can illustratively be a heart rate monitor, or any other type of sensor which can be used to sense the sinus rhythm of the heart. Also, if the heart has stopped beating on its own, system 100 can be pulsed without reference to, or feedback from, the natural sinus rhythm of the heart.

In any case, when heart sensor 108 is used, it senses desired characteristics of the heart of patient 112 through a connection 118. Connection 118 can simply be a conductive contact-type connection, or other known connection, including traditional body-surface EKG electrodes. Sensor 108 is also illustratively connected to controller 106 through a suitable connection 120.

It should be noted that all of the connections or links 114, 118 and 120 can be hard wired or contact-type connections, or they can be other connections as well. For example, connections 114, 118 and 120 can be wireless connections (such as one using infrared, or other electromagnetic radiation) or any other desired connection.

FIG. 1 also illustrates an optional feedback component 110. Feedback component 110 is connected to sense feedback characteristics from patient 112 through a first link 122 and to provide a sensor signal indicative of the sensed characteristics to controller 106 through link 124. In one embodiment, as will be described in greater detail below, the signal from feedback component 110 is used by controller 106 to shift the location and timing of applied pressure using actuators 104 in order to maximize the flow response achieved or the metabolic benefit achieved by system 100. In that embodiment, feedback component 110 includes a flow sensor for sensing blood flow, a pressure sensor for sensing blood pressure, or other conventional transducers for sensing metabolic indicators such as gas partial pressures.

Figure 2:
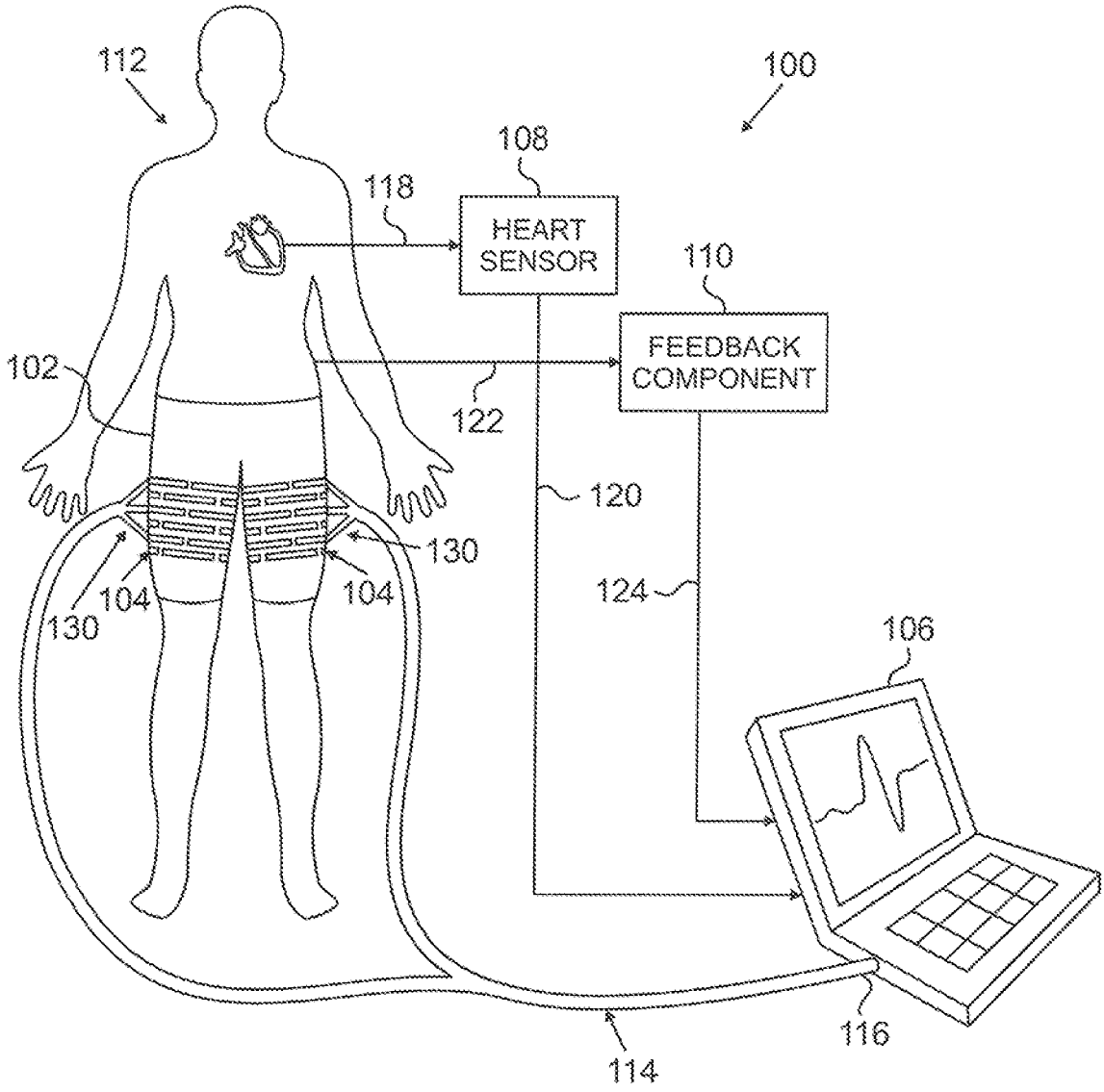
FIG. 2 is a diagrammatic view of the system shown in FIG. 1 placed in compressive relation to a patient.

FIG. 2 shows system 100 in which the lower extremities of patient 112 have been placed in garment 102. During operation, heart sensor 108 illustratively senses the natural sinus rhythm of the heart of patient 112 and provides a signal indicative of that sinus rhythm over link 120 to controller 106.

Based on the sinus rhythm sensed by heart sensor 108, controller 106 provides signals over link 114 to the actuators 104. In one embodiment, the signals cause the actuators to contract according to a timing that is synchronous with the desired sinus rhythm of the heart of patient 112. When actuators 104 contract, they cause garment 102 to exert a compressive force on the lower extremities of patient 112, thereby assisting the compressive portion of the heart function.

It should be noted that different pulsation techniques could be implemented. For example, the signals provided from controller 106 over connection 114 can be provided to all of actuators 104 at once, thus pulsing the entire portion of the lower extremities of patient 112 covered by actuators 104 at the same time. Alternately, however, a plurality of conductive ends 130 can be provided that include conductors carrying additional signals provided by controller 106. In that embodiment, controller 106 can provide these signals to more closely mimic the natural prorogating-pulsing action of blood as it flows through the vessels of the lower extremities of patient 112. Therefore, for instance, based on the feedback from component 110, controller 106 can provide signals which cause actuators 104 nearer the distal end of the extremities to contract before adjacent actuators 104 nearer the proximal end of the extremities. The timing and magnitude of the signals can be varied, based on the feedback from feedback component 110, in order to maximize the benefit obtained by system 100. Any number of optional additional connections 130 can be provided, so long as the appropriate signals are provided from controller 106.

Also, while other actuators are alternatives to EAP actuators, such as piezoelectric or shape memory actuators, they may be less efficient, larger and more expensive than EAP actuators. The small size and efficiency of EAP actuators provide great flexibility in the placement and control of the counterpulsation forces. The low activation voltage and high efficiency of the EAP actuators allow the use of simple, small drive and monitoring circuits, such as those found in conventional personal computer card interfaces. Similarly, the EAP actuators can provide better fit to the extremities, better application of pressure, a smaller profile, and better control of pulsation forces. Also, EAP actuators operate substantially silently, and thus reduce the noise usually associated with external counterpulsation systems. By varying the type, of garments in which the actuators 104 are used, the EAP actuators can easily be placed at the optimum point for application of counterpulsation pressure.

Although the present invention has been described with reference to preferred embodiments, workers skilled in the art will recognize that changes may be made in form and detail without departing from the spirit and scope of the invention.

What is claimed is:

1. A system for exerting a compressive force on an exterior treatment portion of a user's body comprising the user's thighs in synchrony with the heart beat of the user, comprising:

a covering member for covering the treatment portion, said covering member comprising a garment enclosing at least the user's thighs when worn by the user; and a plurality of electroactive polymer (EAP) actuators operably connected to the covering member, wherein said electroactive polymer actuators comprise an electroactive polymer member, a counter electrode and an electrolyte-containing region disposed between the electroactive polymer member and the counter electrode, wherein a plurality of said EAP actuators extend circumferentially around the user's thighs in multiple rows when worn by the user, wherein a plurality of actuators are provided in a spaced relationship in each single row, and wherein the location of the spaces between adjacent actuators in one row is offset from the spaces between adjacent actuators of an adjacent row such that the entire circumference of the treatment portion will be covered by an actuator over a plurality of rows of actuators.

2. The system of claim 1 wherein the EAP actuators are rigidly connected to the garment.

3. The system of claim 2 wherein the EAP actuators are connected to the garment by adhesive.

4. The system of claim 2 wherein the EAP actuators are stitched to the garment.

5. The system of claim 2 wherein the EAP actuators are woven into the garment.

6. The system of claim 1 and further comprising: a controller operably coupled to the EAP actuators to provide a drive signal to drive actuation of the EAP actuators.

7. The system of claim 6 wherein the garment is flexible such that actuation of the EAP actuators drives deformation of the garment.

8. The system of claim 7 and further comprising: a heart sensor sensing a sinus rhythm of the heart and providing a heart sensor signal indicative of the sinus rhythm.

9. The system of claim 8 wherein the controller is configured to provide the drive signal based on the heart sensor signal.

10. The system of claim 9 and further comprising: a feedback component sensing a feedback characteristic and providing a feedback signal indicative of the sensed feedback characteristic.

11. The system of claim 10 wherein the controller is configured to provide the drive signal based on the feedback signal.

12. The system of claim 11 wherein the feedback component comprises: a metabolic sensor sensing a metabolic characteristic and providing the feedback signal based on the metabolic characteristic.

13. The system of claim 11 wherein the feedback component comprises: a blood flow sensor.

14. The system of claim 11 wherein the feedback component comprises: a blood pressure sensor.

15. The system of claim 6 wherein the controller is configured to provide the drive signal to exert counterpulsation force on the treatment portion.

16. The system of claim 1, wherein the electroactive polymer actuator comprises a conducting polymer.

17. The system of claim 1, wherein the electroactive polymer actuator comprises a conducting polymer selected from polyaniline, polypyrrole, polysulfone, polyacetylene and combinations thereof.

18. A counterpulsation apparatus, comprising: a garment enclosing at least the thighs of a user when worn by the user; and a plurality of electroactive polymer (EAP) actuators connected to the garment, wherein said electroactive polymer actuators comprise an electroactive polymer member, a counter electrode and an electrolyte-containing region disposed between the electroactive polymer member and the counter electrode, wherein a plurality of said EAP actuators extend circumferentially around the user's thighs in multiple rows when worn by the user, wherein a plurality of actuators are provided in a spaced relationship in each single row, and wherein the location of the spaces between adjacent actuators in one row is offset from the spaces between adjacent actuators of an adjacent row such that the entire circumference of the treatment portion will be covered by an actuator over a plurality of rows of actuators.

19. The counterpulsation apparatus of claim 18 wherein the garment is formed of a fabric material.

20. The counterpulsation apparatus of claim 19 wherein the plurality of EAP actuators are woven into the fabric material.

21. The counterpulsation apparatus of claim 19 wherein the plurality of EAP actuators are stitched to the fabric material.

22. The counterpulsation apparatus of claim 19 wherein the plurality of EAP actuators are connected to the fabric material with adhesive.

23. The counterpulsation apparatus of claim 18 wherein the garment comprises multiple layers of fabric material and wherein the plurality of EAP actuators are disposed between the layers.

24. The counterpulsation apparatus of claim 18, wherein the electroactive polymer actuator comprises a conducting polymer.

25. The counterpulsation apparatus of claim 18, wherein the electroactive polymer actuator comprises a conducting polymer selected from polyaniline, polypyrrole, polysulfone, polyacetylene and combinations thereof.

26. A method of exerting pressure on an external-treatment area of a patient comprising the patient's thighs, comprising: providing a garment to cover the treatment area; and actuating electroactive polymer (EAP) actuators connected to the garment in synchrony with the heart beat of the patient, wherein said electroactive polymer actuators comprise an electroactive polymer member, a counter electrode and an electrolyte-containing region disposed between the electroactive polymer member and the counter electrode, wherein a plurality of said EAP actuators extend circumferentially around the patient's thighs in multiple rows, wherein a plurality of actuators are provided in a spaced relationship in each single row, and wherein the location of the spaces between adjacent actuators in one row is offset from the spaces between adjacent actuators of an adjacent row such that the entire circumference of the treatment portion will be covered by an actuator over a plurality of rows of actuators.

27. The method of claim 26 and further comprising: sensing a heart beat of the patient and providing a heart beat sensor signal indicative of the sensed heart beat.

28. The method of claim 27 and further comprising: actuating the EAP actuators to exert counterpulsation pressure based on the heart beat sensor signal.

29. The method of claim 28 and further comprising: sensing a biological characteristic indicative of an efficaciousness of the counterpulsation pressure and providing a biological sensor signal indicative of the sensed characteristic.

30. The method of claim 29 wherein actuating the EAP actuators comprises: actuating the EAP actuators based on the biological sensor signal.

31. The method of claim 26, wherein the electroactive polymer actuators comprise a conducting polymer.

32. The method of claim 26, wherein the electroactive polymer actuators comprise a conducting polymer selected from polyaniline, polypyrrole, polysulfone, polyacetylene and combinations thereof.

* * * * *